US010948178B2

(12) United States Patent
Brückner et al.

(10) Patent No.: US 10,948,178 B2
(45) Date of Patent: Mar. 16, 2021

(54) METHOD FOR OPERATING A WASTE HEAT STEAM GENERATOR

(71) Applicant: Siemens Aktiengesellschaft, Munich (DE)

(72) Inventors: Jan Brückner, Uttenreuth (DE); Frank Thomas, Erlangen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 82 days.

(21) Appl. No.: 16/314,905

(22) PCT Filed: Aug. 5, 2016

(86) PCT No.: PCT/EP2016/068732
§ 371 (c)(1),
(2) Date: Jan. 3, 2019

(87) PCT Pub. No.: WO2018/024340
PCT Pub. Date: Feb. 8, 2018

(65) Prior Publication Data

US 2019/0338944 A1 Nov. 7, 2019

(51) Int. Cl.
*F22D 5/34* (2006.01)
*F22D 1/12* (2006.01)

(52) U.S. Cl.
CPC ..... *F22D 5/34* (2013.01); *F22D 1/12* (2013.01); *F24D 2200/16* (2013.01)

(58) Field of Classification Search
CPC ..... F22D 5/34
See application file for complete search history.

(56) References Cited

U.S. PATENT DOCUMENTS 3,818,872 A * 6/1974 Clayton, Jr. ..... F22D 1/02 122/406.4
2004/0187687 A1* 9/2004 Liebig ..... F01K 23/106 95/251

(Continued)

FOREIGN PATENT DOCUMENTS

EP 2224164 A1 9/2010
JP S56165204 U 12/1981

(Continued)

OTHER PUBLICATIONS

PCT International Search Report and Written Opinion of International Searching Authority dated Apr. 25, 2017 corresponding to PCT International Application No. PCT/EP2016/068732 filed Aug. 5, 2016.

*Primary Examiner* — Nathaniel Herzfeld

(57) ABSTRACT

A method for operating a waste heat steam generator, in particular one designed according to the forced flow principle, having an evaporator, through which a flow medium flows; an economizer having a number of economizer heating surfaces, and having a bypass line, which on the flow medium side is connected in parallel to a number of economizer heating surfaces. A variable that is characteristic of the heat energy supplied to the waste heat steam generator for controlling or regulating the flow rate of the bypass line is used, wherein the regulating or controlling of the flow rate of the flow medium through the bypass line takes place at the inlet of the evaporator subject to a supercooling target value. The regulating or controlling of the flow rate of the flow medium through the bypass line also takes place at the outlet of the evaporator subject to an overheating target value.

3 Claims, 3 Drawing Sheets

(56) References Cited

U.S. PATENT DOCUMENTS

| | | | | |
|---|---|---|---|---|
| 2011/0023487 | A1* | 2/2011 | Olia | F22B 35/007 60/653 |
| 2011/0225972 | A1* | 9/2011 | Bruckner | F01K 13/02 60/645 |
| 2014/0041601 | A1* | 2/2014 | Brodesser | F22B 29/062 122/1 B |
| 2015/0090202 | A1 | 4/2015 | Nenmeni et al. | |

FOREIGN PATENT DOCUMENTS

| | | | |
|---|---|---|---|
| JP | S6291703 | A | 4/1987 |
| JP | H0275802 | A | 3/1990 |
| WO | 2009150055 | A2 | 12/2009 |
| WO | 2015165668 | A1 | 11/2015 |

* cited by examiner

METHOD FOR OPERATING A WASTE HEAT STEAM GENERATOR

CROSS REFERENCE TO RELATED APPLICATIONS

This application is the U.S. National Stage of International Application No. PCT/EP2016/068732 filed Aug. 5, 2016, claims the benefit thereof, and is incorporated by reference herein in its entirety.

FIELD OF INVENTION

The invention relates to a method for operating a waste heat steam generator, in particular to the load-dependent control of a waste heat steam generator designed according to the forced flow principle.

BACKGROUND OF INVENTION

EP 2 224 164 A1 discloses a method for operating a waste heat steam generator comprising an evaporator, an economizer with a number of economizer heating surfaces, and a bypass line connected in parallel with a number of economizer heating surfaces on the flow medium side. In order to increase the operational safety and reliability of the waste heat steam generator, here a method is disclosed with which, in all load states, formation of a water-vapor mixture at the inlet to the evaporator is to be reliably avoided. To this end, provision is made that a variable that is characteristic of the heat energy supplied to the waste heat steam generator is used for the control or regulation of the flow rate of the bypass line, in order thereby, in the event of an increase in the variable, to reduce the flow rate of the bypass line. As a result, even in the event of an increase in the heat energy supplied to the waste heat steam generator and therefore still before the measurement of an actual change in the temperature or supercooling at the inlet of the evaporator, the flow rate of the bypass line can be adapted appropriately. This is because, in the current operating mode of the waste heat steam generator, if the heat energy supplied to the waste heat steam generator increases, then this is linked with an increase in further thermodynamic state variables of the flow medium (such as, for example, feed water mass flow, pressure, medium temperature), which, because of the physical laws, is directly associated with an increase in the inlet supercooling. Therefore, in such a case, the flow rate of the bypass line should be reduced, so that the temperature at the outlet of the economizer rises and thus the supercooling at the evaporator inlet is reduced. Correspondingly conversely, in the event of a reduction in the variable, the flow rate of the bypass line is advantageously increased, in order thus to adapt the outlet temperature of the economizer in a targeted manner. The control of the flow rate can here also be carried out as a function of a predefined supercooling setpoint.

During the regulation or control of the feed water rate of a waste heat steam generator designed according to the forced flow principle, it has transpired that load-dependent non-steady temperature fluctuations of the flow medium emerging from the evaporator cannot always be avoided optimally merely with the method known from, for example, WO 2009/150055 A2.

SUMMARY OF INVENTION

An object of the invention is, therefore, to provide an optimized method for operating a waste heat steam generator.

This object is achieved by the method having the features of the independent claim.

With the method according to the invention, without greater additional outlay, even fluctuations of the evaporator outlet temperature occurring during non-steady operation of the waste heat steam generator can be effectively minimized. In practical terms, this means that the component loading of the waste heat steam generator can be reduced further under given transient requirements or, with comparatively equal component loading, the plant flexibility can be increased further. To this end, in the device known from EP 2 224 164 A1, adaptations of the basic method for controlling or regulating the flow rate of the flow medium through the bypass line are thus substantially required.

Advantageous developments of the method according to the invention can be gathered from the sub-claims.

BRIEF DESCRIPTION OF THE DRAWINGS

The invention is now to be explained by way of example by using the following figures, in which.

DETAILED DESCRIPTION OF INVENTION

Figure 1:
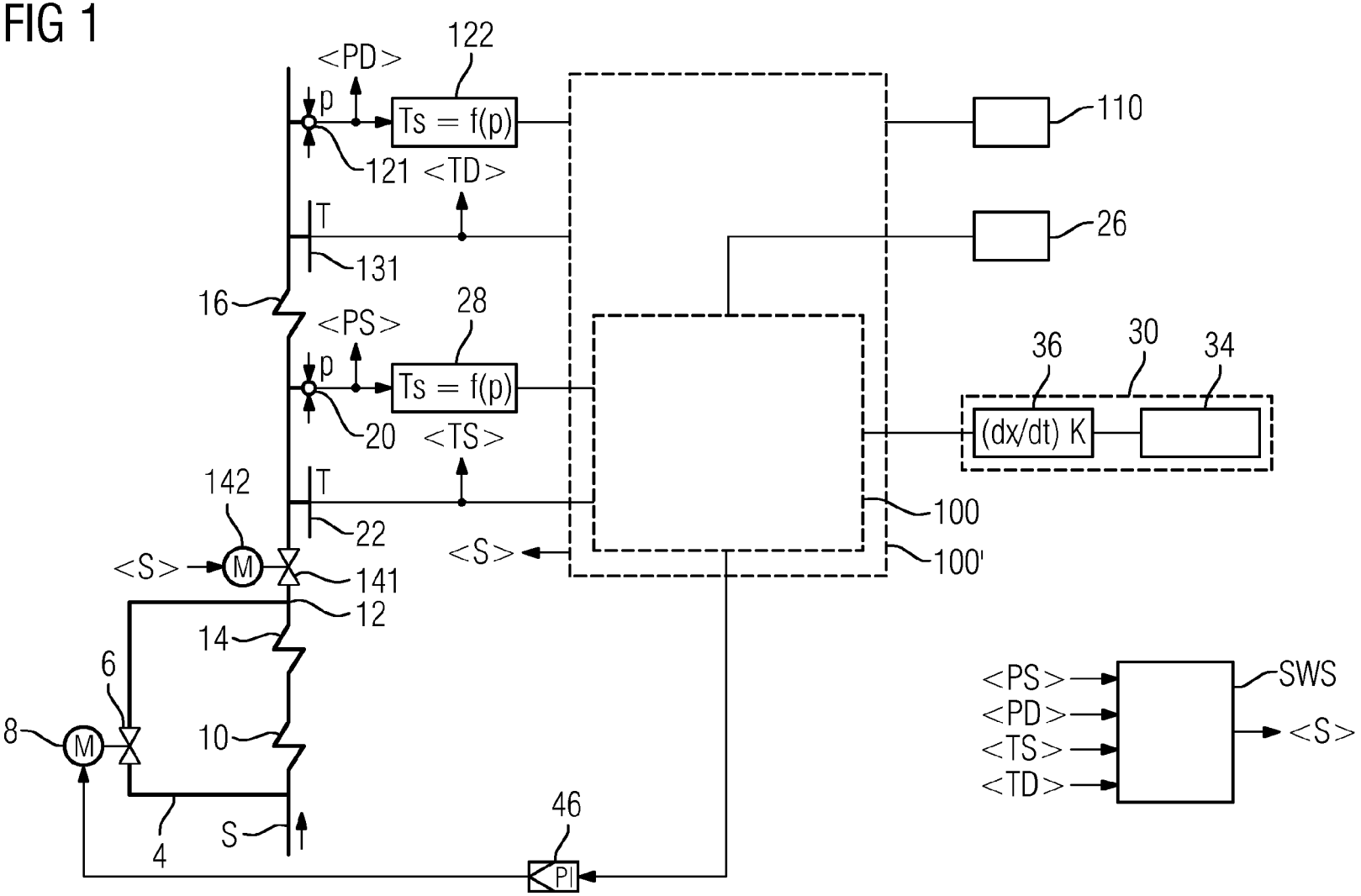
FIG. 1 shows, schematically, a first design for optimized regulation.

FIG. 1 firstly shows, schematically, a first design having regulation for a waste heat steam generator. A flow medium S, driven by a pump, not specifically illustrated, firstly flows into a first pre-heater heating surface or economizer heating surface 10. However, a bypass line 4 already branches off previously. To regulate the flow rate of the bypass line 4, a flow control valve 6, which can be regulated by a controllable motor 8, is provided. It is also possible for a simple control valve to be provided but, by means of a quick-reacting control valve, better adjustment of the supercooling at the evaporator inlet is possible. Part of the flow medium S thus flows into the bypass line 4, depending on the position of the flow control valve 6, another part flows through a first economizer heating surface 10 and then a further economizer heating surface 14. In the present design, at the outlet from the economizer heating surface 14, the flow medium from the bypass line 4 and the economizer heating surface 14 are mixed at a mixing point 12, before it enters the downstream evaporator 16. On the flue gas side, various arrangements of the economizer heating surfaces 10, 14 and of the evaporator 16 are possible. Usually, however, the economizer heating surfaces 10, 14 are connected downstream of the evaporator 16 on the flue gas side, since the economizers carry the comparatively coldest flow medium, and are intended to use the residual heat in the flue gas duct, not specifically illustrated. In order to ensure smooth operation of the waste heat steam generator, sufficient supercooling, which means a sufficient difference of the current temperature from the saturation temperature in the evaporator, should be present at the evaporator inlet, so that a sufficiently liquid flow medium is present. Only in this way is it possible to ensure that reliable distribution of the flow medium to the individual evaporator tubes in the evaporator 16 takes place. In order to regulate the supercooling at the evaporator inlet, a pressure measuring device 20 and a temperature measuring device 22 are provided at this location. On the regulation side, firstly a supercooling setpoint 26 is predefined at the evaporator inlet. This can be, for example, 3K, i.e. the temperature at the evaporator inlet is intended to lie 3K below the saturation temperature in the evaporator 16. From the pressure determined at the pressure measuring device 20, a saturation temperature 28 of the evaporator 16 is determined, since this is a direct function of the pressure prevailing in the evaporator 16. The regulating and control device 100 known from EP 2 224 164 A1 uses these values and assesses them as a function of a variable 30 that is characteristic of the heat energy supplied and of the supercooling setpoint 26 that is preset or defined in advance and which is intended to be present at the inlet of the evaporator 16. This then results in a suitable control value for control of the flow control valve 6 of the bypass line 4.

According to the invention, a regulating and control device 100' that is expanded as compared with the regulating control device 100 known from EP 2 224 164 A1 is provided. Here, the control and regulation of the flow rate of the bypass line 4 is carried out as a function of a variable 30 that is characteristic of the heat energy supplied to the waste heat steam generator and as a function of a supercooling setpoint 26 at the inlet of the evaporator 16 and, in addition, as a function of a superheating setpoint 110 at the outlet of the evaporator 16. The superheating setpoint 110 predefines in this case a setpoint for an outlet temperature of the flow medium at the evaporator 16. To regulate the superheating at the evaporator outlet, at this location a pressure measuring device 121 and a temperature measuring device 131 are provided, which are processed accordingly in the expanded regulating and control device 100'.

For completeness, a feed water control device SWS for controlling the feed water main valve 141 is also sketched in FIG. 1. Here, the control is carried out by an appropriate feed water control device SWS, as is already known, for example, from WO 2009/150055 A2. The pressures<PS> and <PD> and the temperatures<TS> and <TD> are tapped off before and after the evaporator, processed appropriately by the feed water control device SWS and then passed on as a control signal<S> to the motor 142 of the feed water main valve. Although this feed water regulation is not a subject of the present invention, the controls of the flow control valve 6 of the bypass line and of the feed water main valve 141 must be coordinated with one another in terms of their respective control behavior in order to ensure secure operation of the waste heat steam generator in all load ranges.

Figure 2:
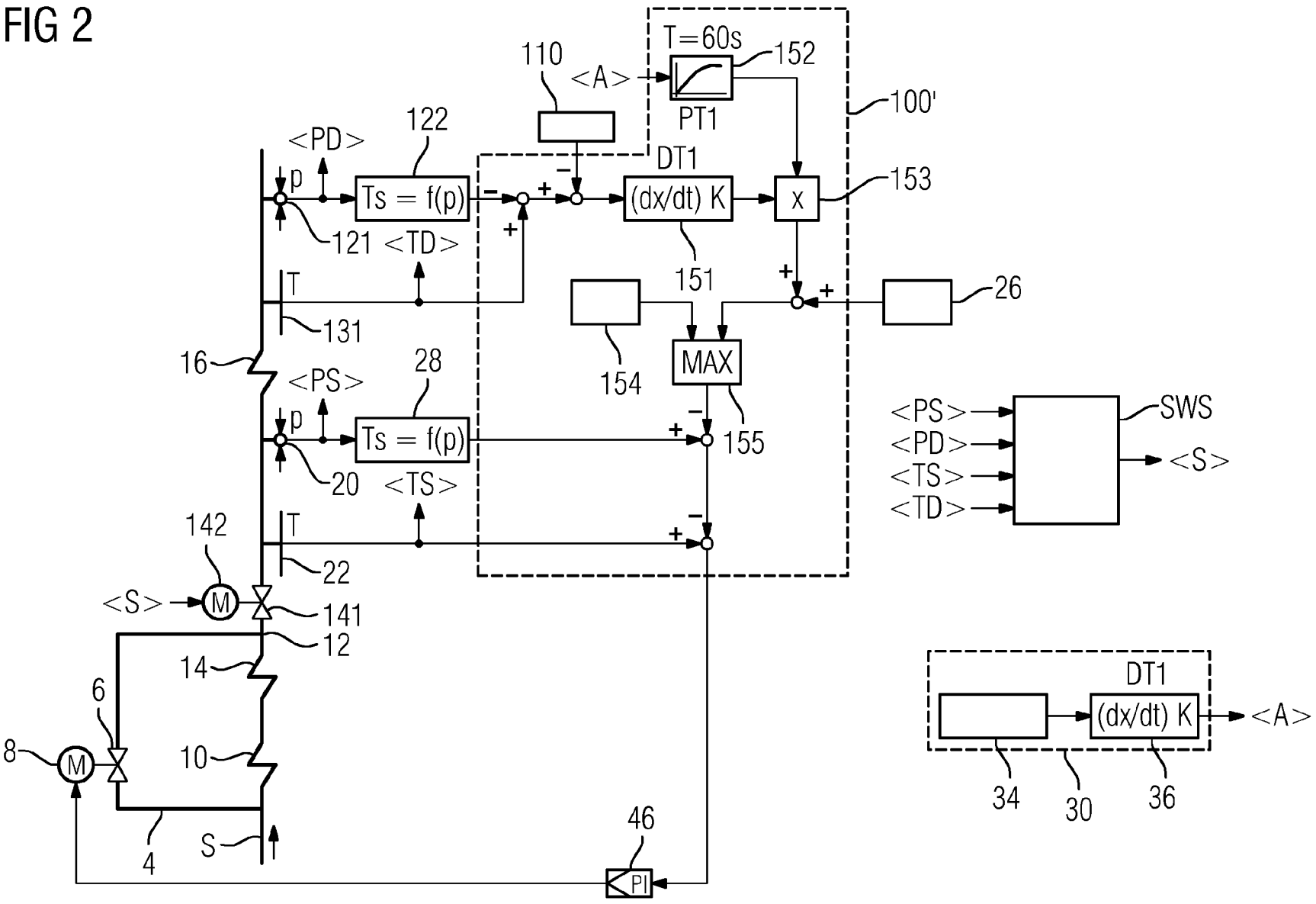
FIG. 2 shows, schematically, details of the exemplary embodiment shown in FIG. 1.
Figure 3:
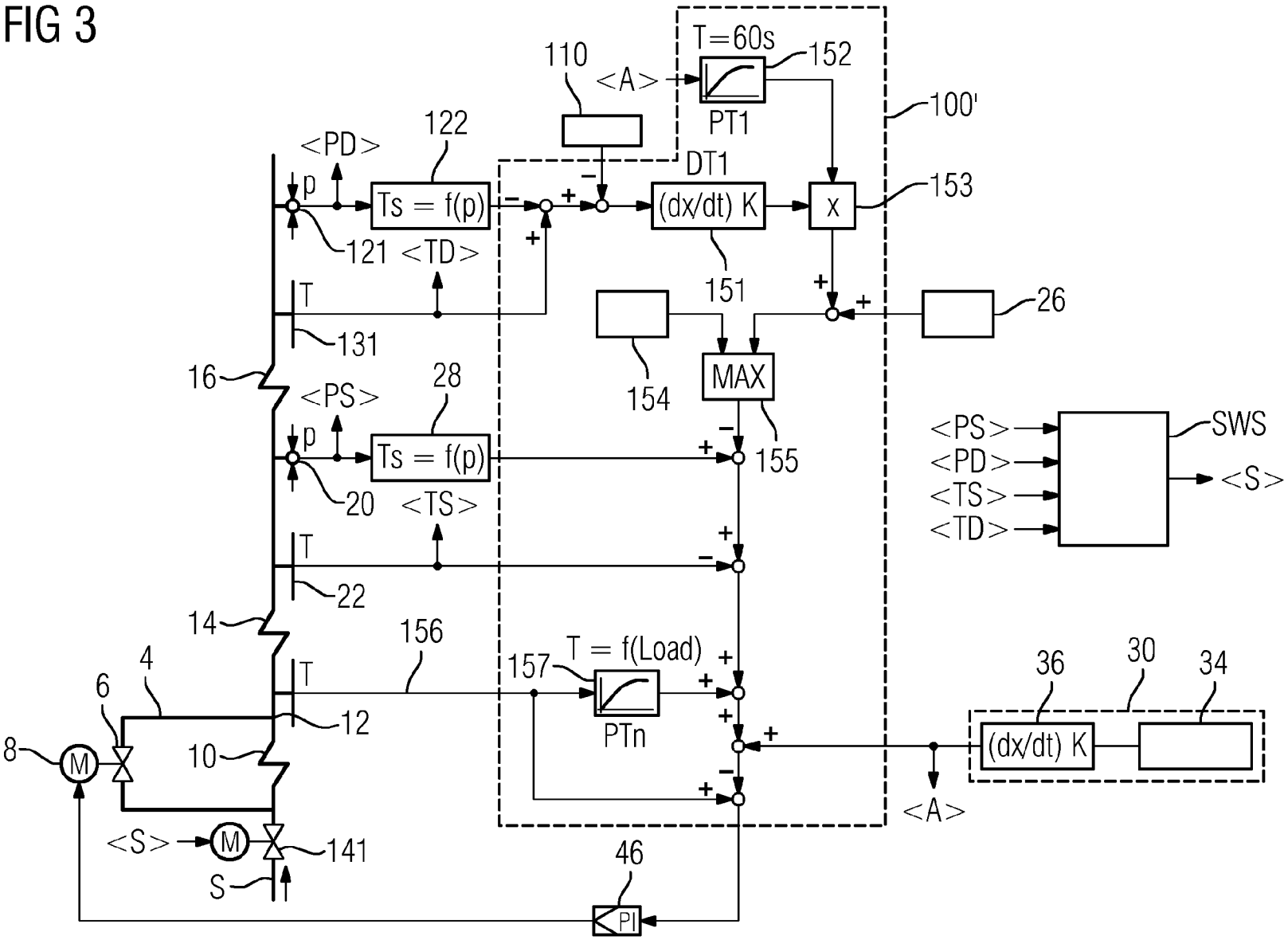
FIG. 3 shows, schematically, a second exemplary embodiment.

Against the background of physical principles, fluctuating inlet temperatures in a waste heat steam generator designed in accordance with the forced flow principle result in fluctuations of the outlet temperature. Here, falling inlet temperatures on account of falling specific volumes and the directly linked reduction in the evaporator flow lead to rising temperatures and superheating at the evaporator outlet. The converse is correspondingly true. In general, this is an undesired effect during non-steady operation, which should be compensated as far as possible by suitably implemented countermeasures in the control concept for the feed water main valve 141. On account of the high load gradients which are usually applied nowadays, however, this is not always possible merely via the feed water regulation. For an improvement in this situation, the present invention is used, but which now follows precisely the opposite route and makes use of the previously described undesired physical effect. By means of specific manipulation or changing of the evaporator inlet temperature in a suitable way, a reaction is made to deviations of the evaporator outlet temperature relative to the predefined setpoint, in order in this way to keep fluctuations of the outlet temperature as low as possible. For instance, if in the non-steady case the evaporator outlet temperature falls undesirably sharply, the evaporator flow can be reduced temporarily by a reduction in the evaporator inlet temperature (opening the flow control valve 6 of the bypass line 4), and thus the outlet temperature can be supported. For the converse case, the evaporator inlet temperature should be increased (closing the flow control valve 6 of the bypass line 4), in order to counteract a rise in the evaporator outlet temperature by means of a temporary increase in the evaporator flow. However, here it is necessary to take care that, against a background of thermohydraulic points of view, a maximum evaporator inlet temperature should not be exceeded or a minimum required inlet supercooling should not be undershot. Furthermore, the method according to the invention assumes that the expanded regulating and control device 100' is also actually capable of influencing the evaporator inlet temperature in the desired direction. In practical terms, this means that, for a further reduction in the evaporator inlet temperature, the flow control valve 6 must not already have been opened fully, while for an increase it should not have been closed fully. Furthermore, it is particularly advantageous for the method presented here if the secondary flow led around the economizer heating surfaces is not already admixed with the main flow of the flow medium again before the last economizer stage but directly at the evaporator inlet, since only in this way can the rapid change in the evaporator inlet temperature required under certain circumstances be ensured. The risk of incorporating the bypass flow at the evaporator inlet lies, however, in possible vapor formation in the last economizer stage, which is to be avoided. Displacing the feed water control valve from the inlet of the first economizer stage (as illustrated in FIG. 3) to the inlet of the evaporator (as illustrated in FIGS. 1 and 2) can ensure a suitable remedy here. As a result of the associated higher system pressure in the economizer heating surfaces, undesired vapor formation in the last economizer heating surface does not take place, because of the physical properties.

FIG. 2 now shows further details of the basic control concept shown in FIG. 1. Here, first of all a difference between the determined superheating at the evaporator outlet and a superheating setpoint 110 is formed, and then a rate of change of this difference is calculated. This is done optimally by using an additional differential term of first order 151, the input of which is connected to the difference of target and actual superheating. Advantageously, the output of this differential term 151 is further multiplied by the time-delayed value 152 of the variable 30 that is characteristic of the energy supplied and is added to the supercooling setpoint 26. In order not to undershoot a required minimum supercooling at the evaporator inlet, this sum must additionally be secured via a max-choice element 155 with the desired minimum supercooling 154.

FIG. 3 shows a further exemplary embodiment, in which the feed water control valve 141 is arranged upstream of the first economizer heating surface 10, and the incorporation 12' of the bypass line 4 between the two economizer heating surfaces 10 and 14 is provided. The expanded regulating and control device 100' now takes into account, in the sense of a classical two-circuit control loop in comparison with the exemplary embodiment in FIG. 2, the time-delayed value 157 of the temperature at the inlet of the economizer 14, determined with the aid of a further measuring device 156. This ensures that, despite the time-delayed behavior of the temperature of the flow medium at the evaporator inlet, caused by the economizer 14, in the event of non-steady plant behavior the eco-bypass regulating device 100' is able to act as quickly as possible and nevertheless stably at the same time.

If the method according to the invention is used in a waste heat steam generator designed in accordance with the forced flow principle, fluctuations of the superheating at the evaporator outlet can effectively be reduced, as simulations of a sub-critical evaporator system of such a forced flow waste heat steam generator have shown. The fluctuations of the evaporator outlet superheating amount to about 90K without the application of the method indicated here, while these fluctuations can be reduced to about 50K when the concept according to the invention is applied.

The invention claimed is:

1. A method for operating a waste heat steam generator, comprising an evaporator through which a flow medium flows, an economizer comprising a number of economizer heating surfaces, and a bypass line connected in parallel with the number of economizer heating surfaces on a flow medium side, the method comprising:

supplying a variable that is characteristic of heat energy to the waste heat steam generator to regulate or control a flow rate of the flow medium through the bypass line, wherein a regulation or control of the flow rate of the flow medium through the bypass line is carried out as a function of a supercooling setpoint at an inlet of the evaporator, and wherein the regulation or control of the flow rate of the flow medium through the bypass line is also carried out as a function of a superheating setpoint at an outlet of the evaporator, wherein the superheating setpoint is predefined as a setpoint for an outlet temperature of the flow medium at the evaporator;

measuring a temperature of the flow medium at the outlet of the evaporator;

increasing the flow rate of the flow medium through the bypass line when the measured temperature of the flow medium is under the superheating setpoint; and lowering the flow rate of the flow medium through the bypass line when the measured temperature of the flow medium exceeds the superheating setpoint.

2. The method as claimed in claim 1, wherein the supercooling setpoint is predefined as a setpoint for an inlet temperature of the flow medium at the evaporator.

3. The method as claimed in claim 1, wherein the waste heat steam generator is designed according to a forced flow principle.

* * * * *